US006519873B1

(12) United States Patent
Buttigieg

(10) Patent No.: US 6,519,873 B1
(45) Date of Patent: Feb. 18, 2003

(54) PLASTIC BELLOWS INSERTED INTO SOLES

(75) Inventor: Carmel Buttigieg, Triq Il-Ferrovija Santa Venera (MT)

(73) Assignee: Yamamoto Limited, Valletta (MT)

( * ) Notice: Subject to any disclaimer, the term of this patent is extended or adjusted under 35 U.S.C. 154(b) by 0 days.

(21) Appl. No.: 09/686,340

(22) Filed: Oct. 10, 2000

(30) Foreign Application Priority Data

Oct. 21, 1999 (MT) ..... 1398

(51) Int. Cl.[7] ..... A43B 13/20
(52) U.S. Cl. ..... 36/29
(58) Field of Search ..... 36/29, 35 B, 28

(56) References Cited

U.S. PATENT DOCUMENTS

| | | | | |
|---|---|---|---|---|
| 1,568,405 | A | * | 1/1926 | Keller |
| 4,446,634 | A | * | 5/1984 | Johnson et al. |
| 4,462,171 | A | | 7/1984 | Whispell |
| 4,918,838 | A | | 4/1990 | Chang |
| 5,068,981 | A | * | 12/1991 | Jung |
| 5,222,312 | A | * | 6/1993 | Doyle |
| 5,295,314 | A | | 3/1994 | Moumdjian |
| 5,655,315 | A | * | 8/1997 | Mershon |
| 5,673,498 | A | * | 10/1997 | Amir et al. |
| 5,794,361 | A | * | 8/1998 | Sadler |
| 5,813,142 | A | * | 9/1998 | Demon |

FOREIGN PATENT DOCUMENTS

| | | | |
|---|---|---|---|
| DE | 3031818 | | 4/1982 |
| EP | 576734 | * | 1/1994 |
| WO | 9854996 | | 12/1998 |

* cited by examiner

*Primary Examiner*—Ted Kavanaugh
(74) *Attorney, Agent, or Firm*—Bucknam and Archer

(57) ABSTRACT

A plastic bellow system inserted into the sole of a shoe. The system having a first pair and a second pair of side-by-side plastic bellows in the forward portion and the rear portion of the shoe sole. The bellows placed in hollows formed in a midsole. The first pair of bellows having two convolutions with an opening formed in the lower convolution. The second pair of bellows having three convolutions with an opening formed in the lower convolution. A pneumatic valve associated with each bellows and the exterior of the midsole. The user can modify foot position by operating the valve of each bellows of the first and second pair of plastic bellows to inflate or deflate each bellows to thereby modify the volume of each bellows.

5 Claims, 8 Drawing Sheets

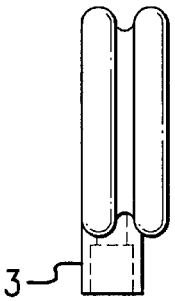
FIG.1B3
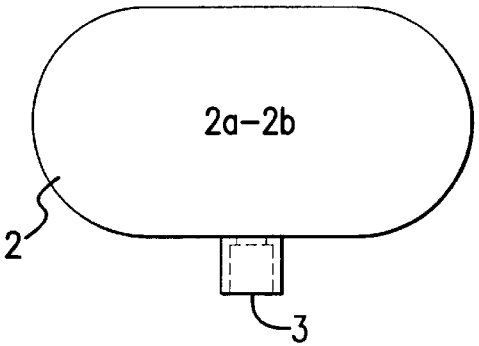
FIG.1B1
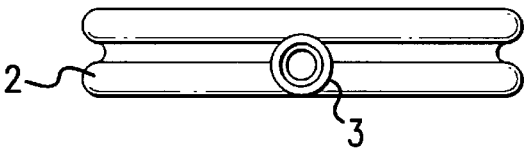
FIG.1B2
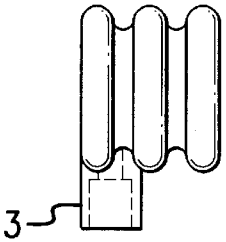
FIG.1A3
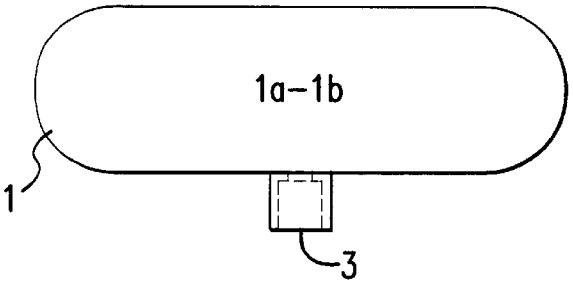
FIG.1A1
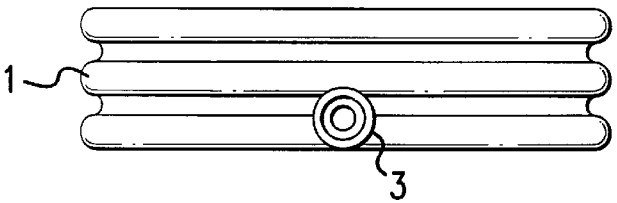
FIG.1A2

PLASTIC BELLOWS INSERTED INTO SOLES

DESCRIPTION OF THE PRIOR ART

Up until today all of the producers of shoes have proposed to the market a lot of special devices inserted into soles for a better cushioning effect. Generally all the systems used for this purpose are located in the rear part of the sole and often are special plastic blisters filled with air or a gel. These special mattresses give the customer a sensation of cushion, but, wearing the shoes for a long time, sometime some pains or biomechanical diseases occur.

The reason is that if a customer has a foot problem as over pronation or impacting the ground with the heel he has an inversion or eversion problem, the air or gel contained into these blisters is compressed where this problem exists, moving this air or gel to the opposite side, with the result that the biomechanical anomaly is increased.

The use of separate plastic bellows which can be self inflatable and self deflatable can correct foot anomalies and can prevent foot injuries.

SUMMARY OF THE INVENTION

The crux of this invention resides in the insertion of special plastic bellows into the sole.

How the bellows work inside a sole.

These bellows are produced with the process of blow moulding or rotational moulding using special polymers defined engineering thermoplastic elastomers which are characterized by their high elastic modulus and therefore give the bellows the possibility to react instantaneously when compressed.

If they are vacuum formed have an enormous elasticity, giving the sole the best cushioning effect.

If they have a hole pre-formed in any side, if compressed they eject the internal air, but always, when the compression is over, they come back to the original position.

In this case if a pneumatic valve is put into the hole, this valve can regulate the air flow, making the bellows self inflatable and self deflatable.

This invention relates on the applications of these innovative technologies with the use of valves as following:

A—A sole with two or four self inflatable and self deflatable bellows for corrective shoes, B—A sole with four self inflatable and self deflatable bellows for shoes for diabetics, C—A sole with one or more simple bellows for walking and running shoes with a special cushioning effect, D—A sole with one or more self inflatable and self deflatable bellows for the support of the plantar arch,

BRIEF DESCRIPTION OF THE DRAWINGS

FIG. 1A1 is a plan view of a plastic bellows for insertation into a shoe according to the present invention;

FIG. 1A2 is a front elevational view of the plastic bellows shown in FIG. 1A1;

FIG. 1A3 is a side elevational view of the plastic bellows shown in FIG. 1A1;

FIG. 1B1 is a plan view of a second embodiment of a plastic bellows for insertation into a shoe according to the present invention;

FIG. 1B2 is a front elevational view of the plastic bellows shown in 1B1;

FIG. 1B3 is a side elevational view of the plastic bellows shown in FIG. 1B1;

In FIGS. 1–4 the application—A—and all the components of the system are shown, where:

Figure 2A:
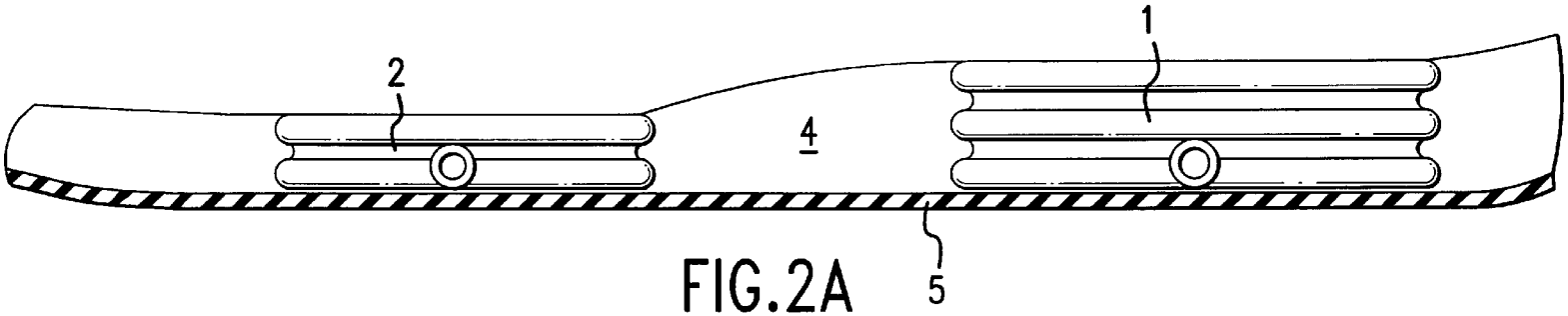
FIG. 2A is a side elevational view of a show midsole shown partly in cross-section showing the plastic bellows of the present invention installed therein.
Figure 2B:
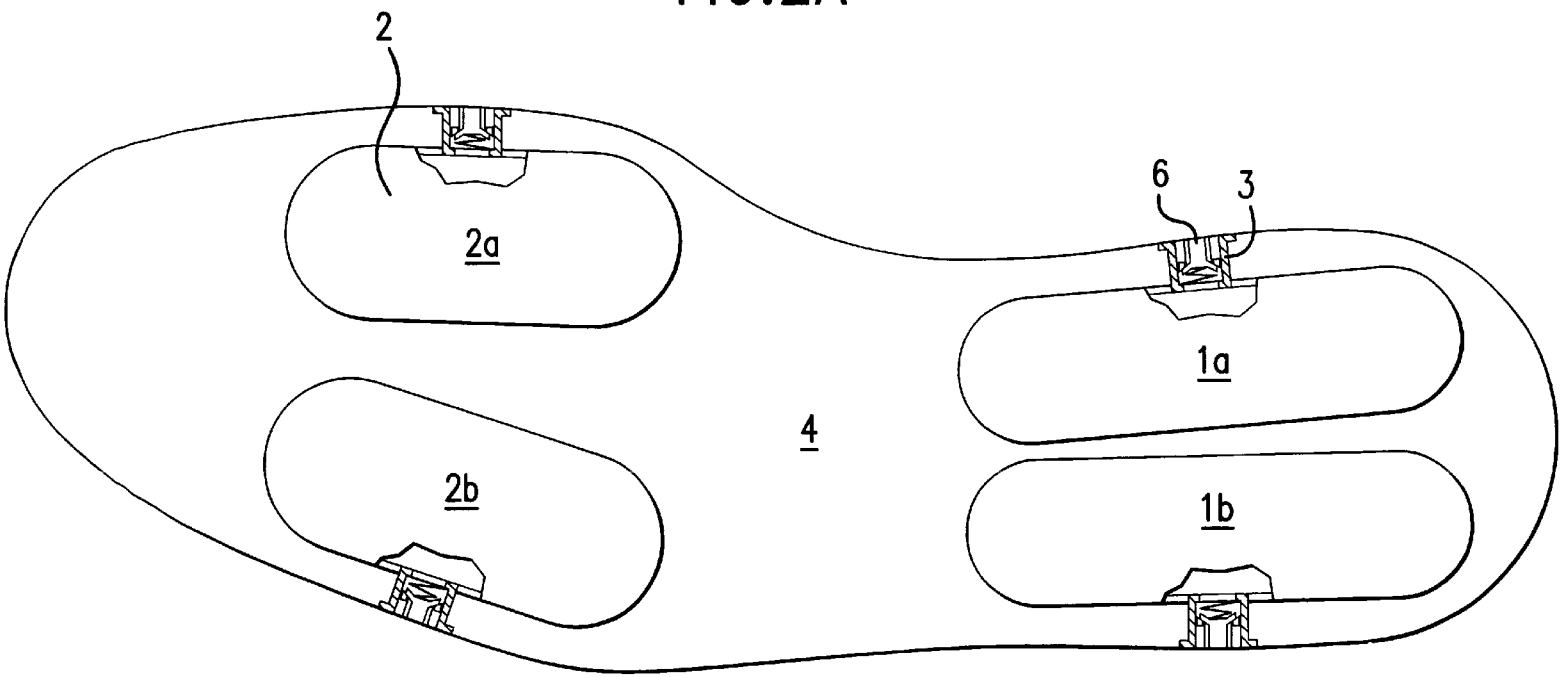
FIG. 2B is a plan view of the show midsole shown in FIG. 2A.

The plastic bellows may have three convolutions (1) or two convolutions (2), from the lower convolution a tube (3) comes out. In both these cases these convolutions are inserted in a midsole (4) produced with foamed plastic material as PU—polyurethane- or EVA—ethylene-vinyl-acetate or other foamed materials obviously with the corresponding hollows pre-formed in order to place the bellows. This midsole is normally glued or pre-formed with the corresponding outersole (5).The tube (3) is formed on the longitudinal side of the bellows, corresponding to the edge of the midsole (4) as in—FIG. 2—or on the head of the bellows, corresponding to the inner part of the midsole (4) as in—FIG. 3—In the case—FIG. 2—a special pneumatic valve (6) is directly inserted into this tube.

Figure 3A:
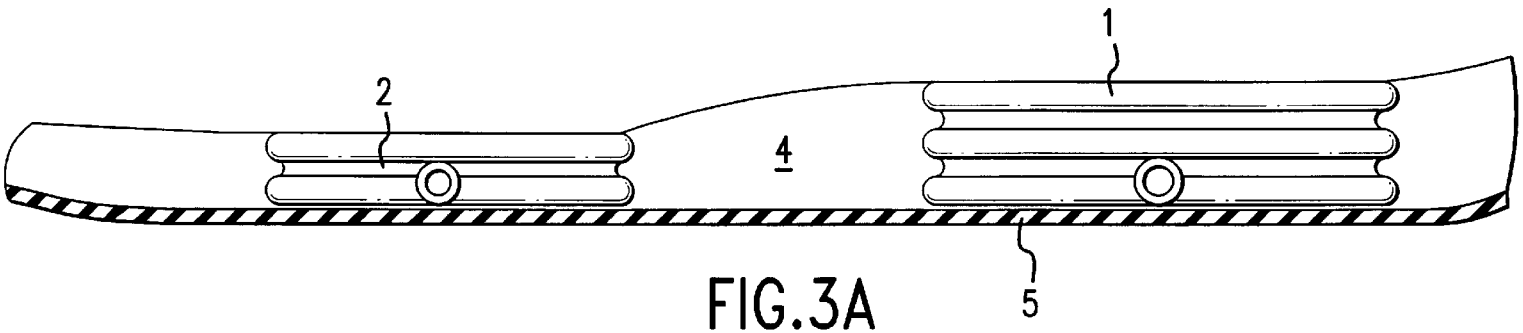
FIG. 3A is a side elevational view of a shoe midsole similar to FIG. 2A showing another embodiment of thereof.
Figure 3B:
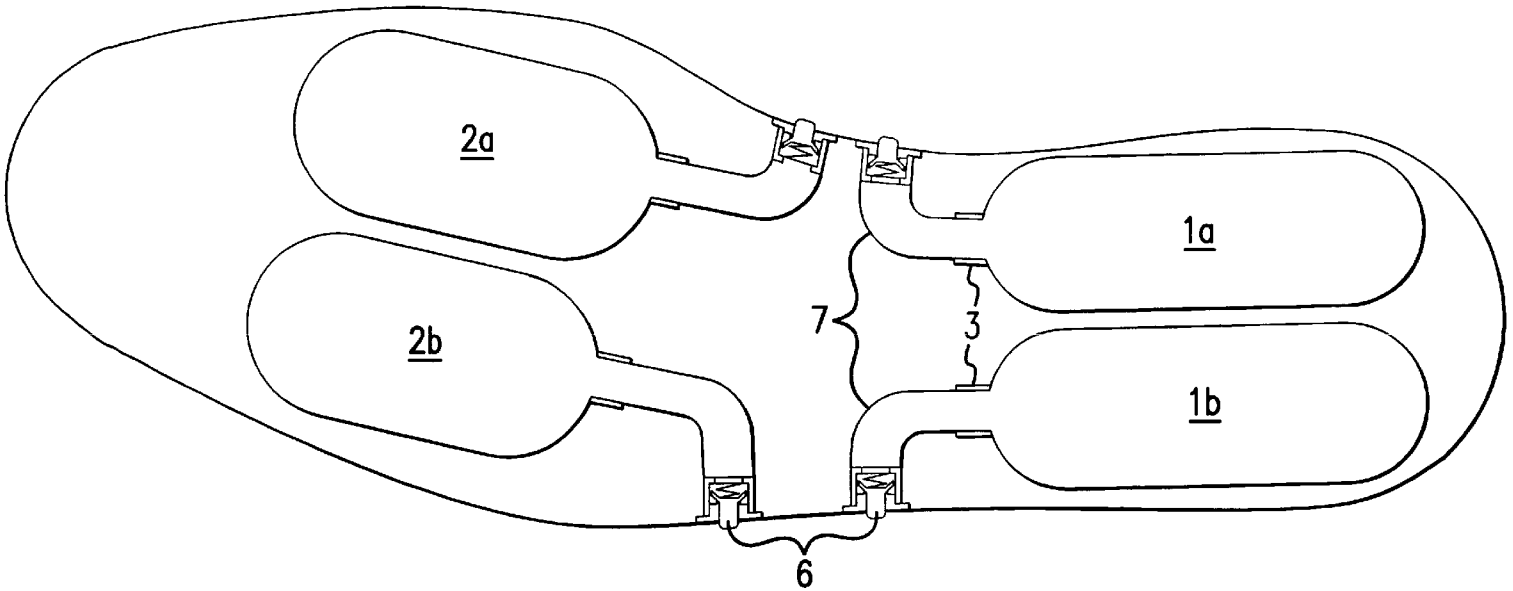
FIG. 3B is a plan view of the show midsole shown in FIG. 3A.
Figure 4:
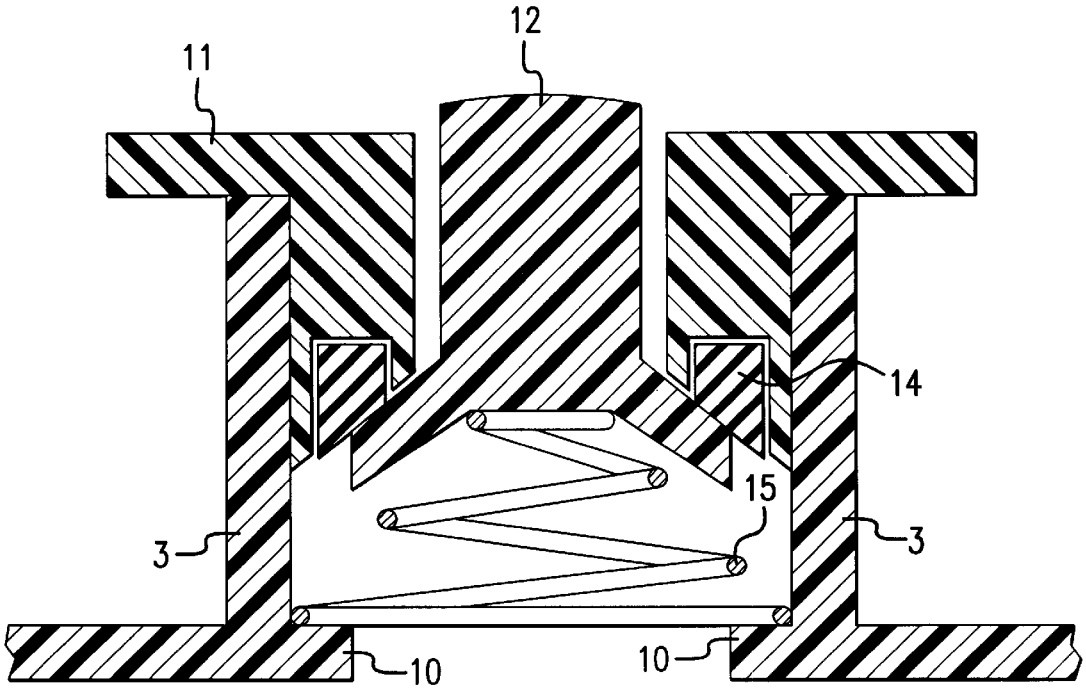
FIG. 4 is a cross-sectional view of the pneumatic valve used in the plastic bellows of the present invention.

In the case—FIG. 3—a tube (7) is inserted into this tube (3) which will go to the nearest edge of the midsole. Internally this tube (7) the same pneumatic valve (6) is inserted. In FIG. 4 is shown how this valve is composed:

A ring (11) which enters the tube (3) or (7). On its inner side it has a gasket (14), A spring (15) which reacts between the inner head of the push-button (12) and the inner teeth (10) pre-formed in the tubes (3) or (7). The push-button (12), whose head overcomes the edge of the midsole (4) and whose arms are in opposition to the gasket (14) push on the inner part of the ring (11).

How this valve works:

Taking on a hand a shoe, therefore when the bellows are not compressed by the body load, pushing the push-button (12) with a finger, will allow the entry of the air, because its natural property to extend the convolutions due to the high elastic modulus of its material and the bellows will inflate to its maximum.

If the shoe is worn and the wearer pushes, with his foot, on a specific area of the sole, he will compress this area which corresponds to one or more bellows. Now pushing with a finger the push-button, the air will come out, deflating the bellows. This exit of the air can be regulated because if the push is terminated before the total compression of the bellows, a part of the air will remain in the interior and the bellows will be partially deflated.

For the application—A—the system will work as follows: Corrective Shoes

The basic foot anomalies are:

1*a*—Inversion. When the foot touches, during the impact phase, the ground internally,

1*b*—Eversion. When the foot touches, during the impact phase, the ground externally,

1*c*—Over-pronation, or "pronation". When the foot leaves the ground, during the push—off phase, pushing internally,

1*d*—Sub-pronation, or "supination". When the foot leaves the ground, during the push—off phase, pushing externally.

With reference to FIGS. 1–4:

To correct an inversion the bellows located in the rear part and innerly (1*a*) must be totally inflated and the opposite (1*b*) partially or totally deflated.

To correct an eversion the bellows located in the rear part and externally (1*b*)must be totally inflated and the opposite (1*a*) partially or totally deflated.

To correct an over-pronation the bellows located in the front part and in the interior (2*a*) must be totally inflated and the opposite (2*b*) partially or totally deflated.

To correct a sub-pronation the bellows located in the front part and externally(2*b*) must be totally inflated and the opposite (2*a*) partially or totally deflated. These adjustments of the inner air can be regulated as a function of the gravity of the anomalies.

For the application—B—the system will work as follows: Shoes for Diabetics

The diabetic neuropathy can lessen the patient's ability to feel pain, this loss of sensation is the problem that leads most often foot injuries. A foot injury can go unnoticed until there is skin ulceration and infection which can lead to gangrene and amputation. An excellent habit for a diabetic is to change the shoes during the day four-five times. Following this advice the patient will never be in danger of an ischemic pressure ulcer because the shoes being changed will be tight in a different place. This advice is the best one that the experts can give the patient but unfortunately it is quite impossible to bring several pairs of shoes during the entire day. It is obvious that by using soles that can be inflated or deflated in prefixed points, a patient can modify, during the day, the position of the foot. Therefore for preventing diabetic foot injuries the bellows system will work as follows:

Starting from the morning the system will be totally air loaded,

First four–five hours one bellows, i.e."inversion" (1*a*), will be deflated, Second four–five hours another bellows, i.e. "pronation" (2*a*), will be deflated, Third four–five hours another bellows, i.e. "supination" (2*b*), will be deflated, Fourth four–five hours another bellows, i.e. "eversion" (1*b*), will be deflated.

Figure 5A:
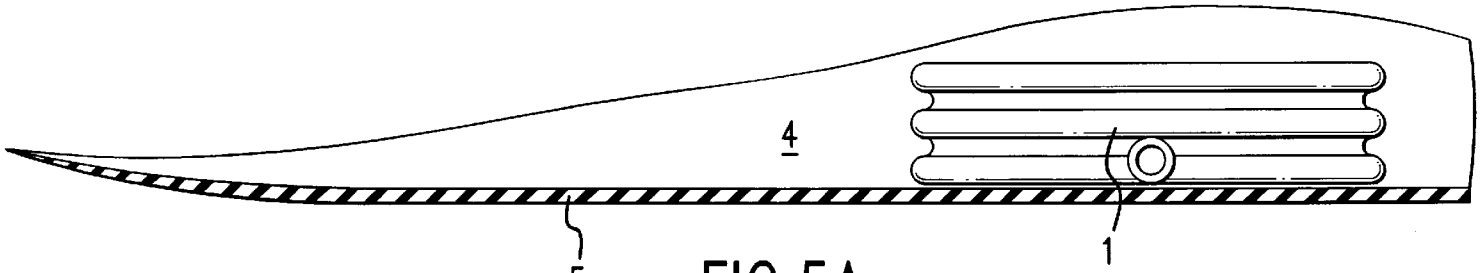
FIG. 5A is a side elevational view of a show midsole similar to FIG. 2A showing another embodiment thereof.
Figure 5B:
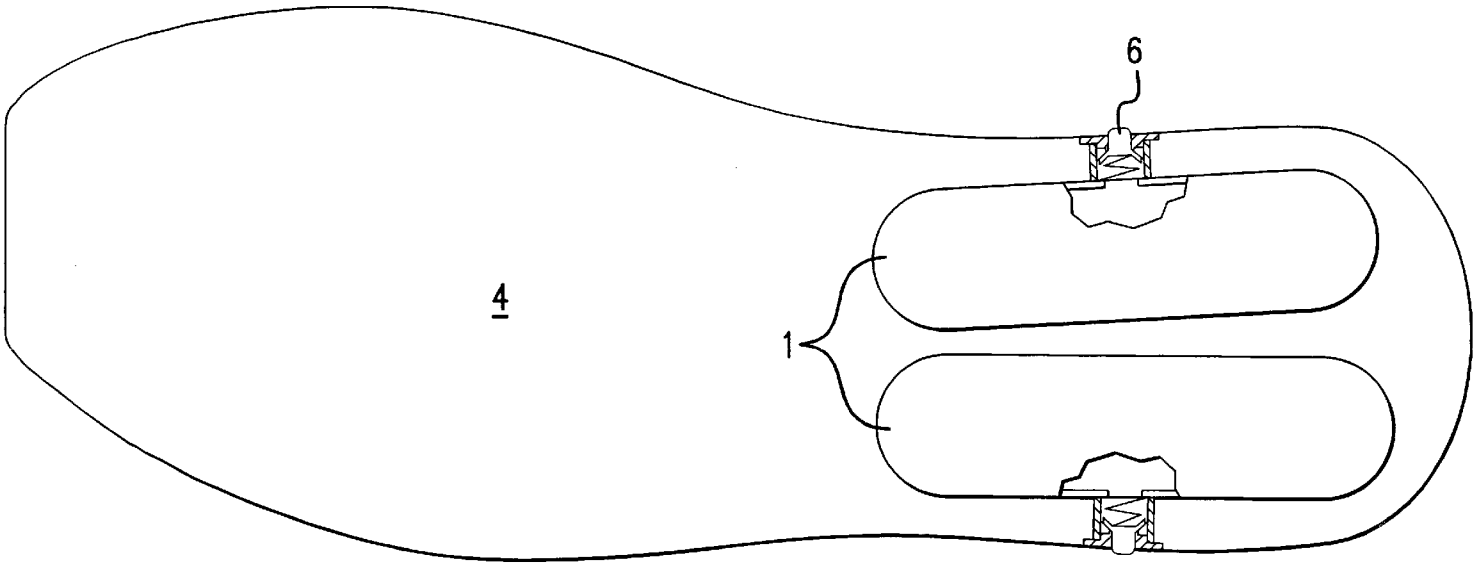
FIG. 5B is a plan view of the shoe midsole shown in FIG. 5A.
Figure 6A:
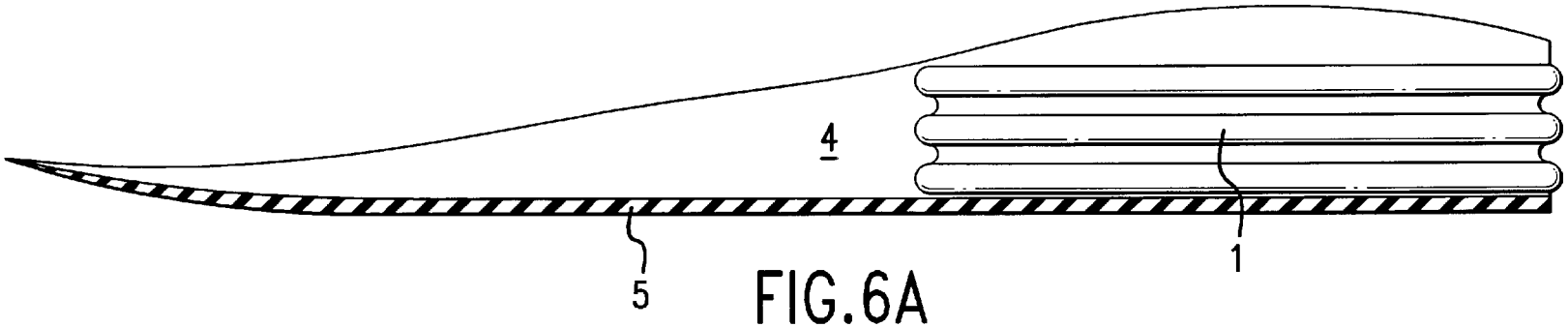
FIG. 6A is a side elevational view of a shoe midsole similar to FIG. 2A showing another embodiment thereof.
Figure 6B:
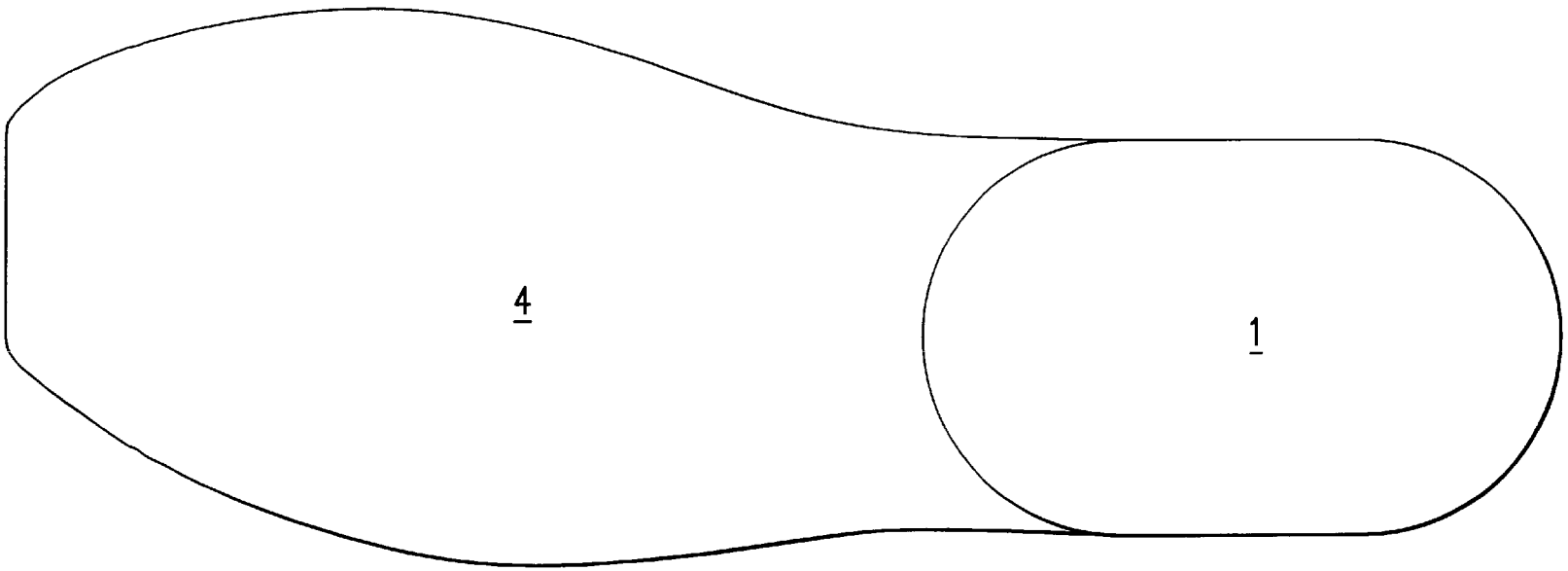
FIG. 6B is a plan view of the shoe midsole shown in FIG. 6A.
Figure 7B:
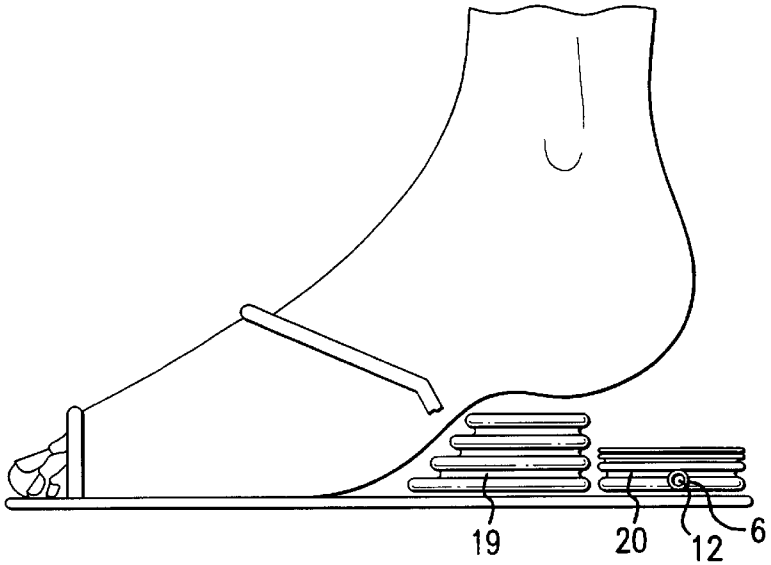
FIG. 7B is a plan view of slipper shown in FIG. 7A.
Figure 7D:
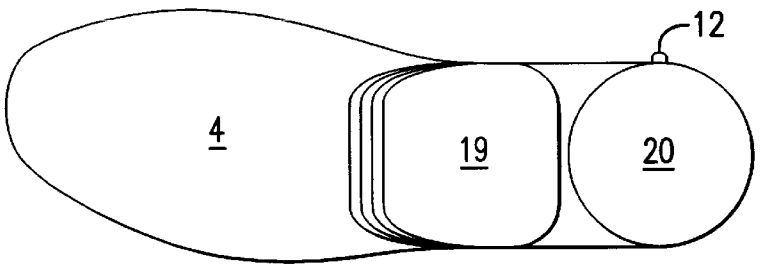
FIG. 7D is a plan view of the slipper shown in FIG. 7C.
Figure 7A:
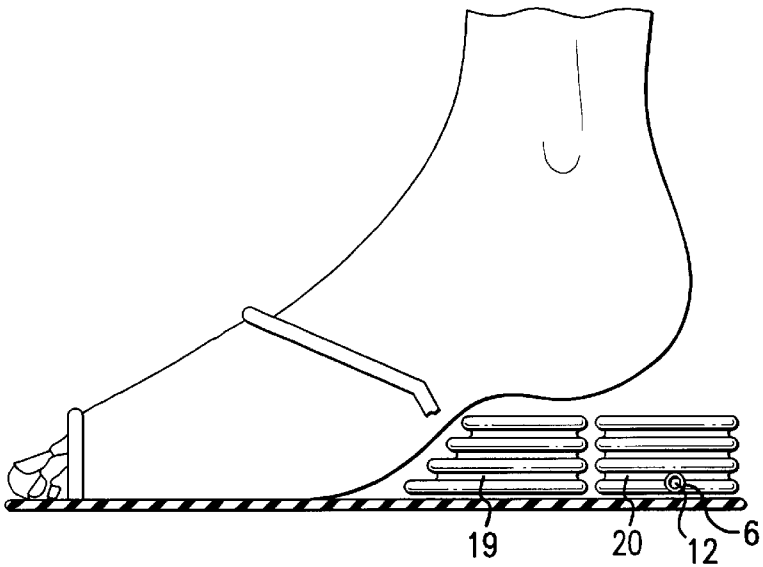
FIG. 7A is a side elevational view of a slipper shown partly in cross-section on a foot for supporting the plantar arch.
Figure 7C:
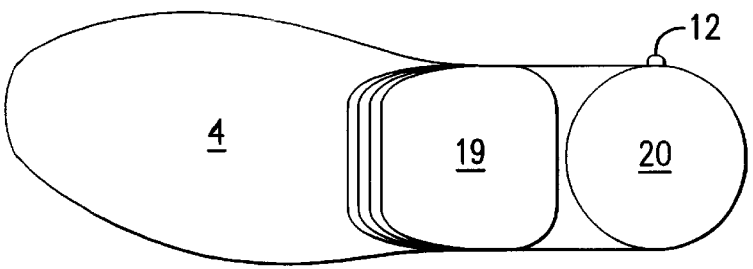
FIG. 7C is a view similar to FIG. 7A wherein one of the plastic bellows is deflatable.
Figure 8A:
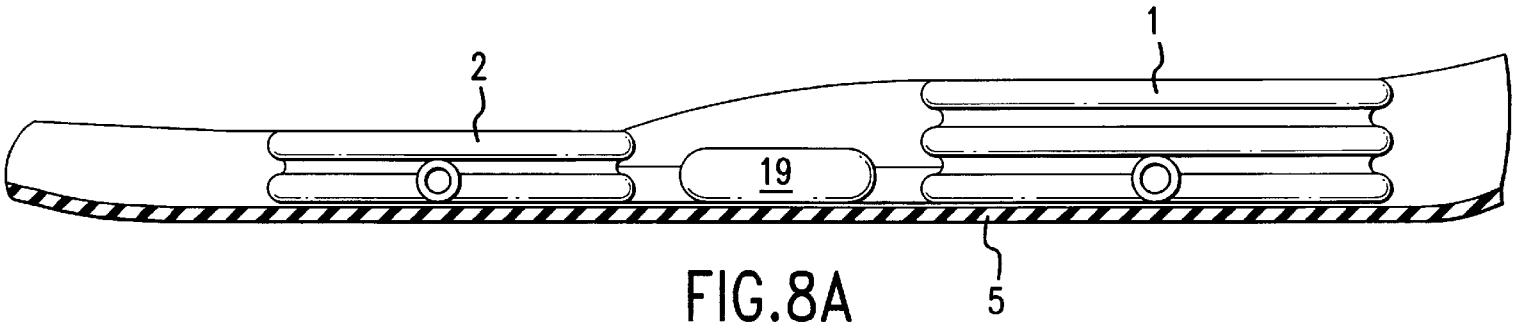
FIG. 8A is a side elevational view of a shoe midsole similar to FIG. 2A showing another embodiment wherein an intermediate plastic bellows is interconnected to the front and rear bellows.
Figure 8B:
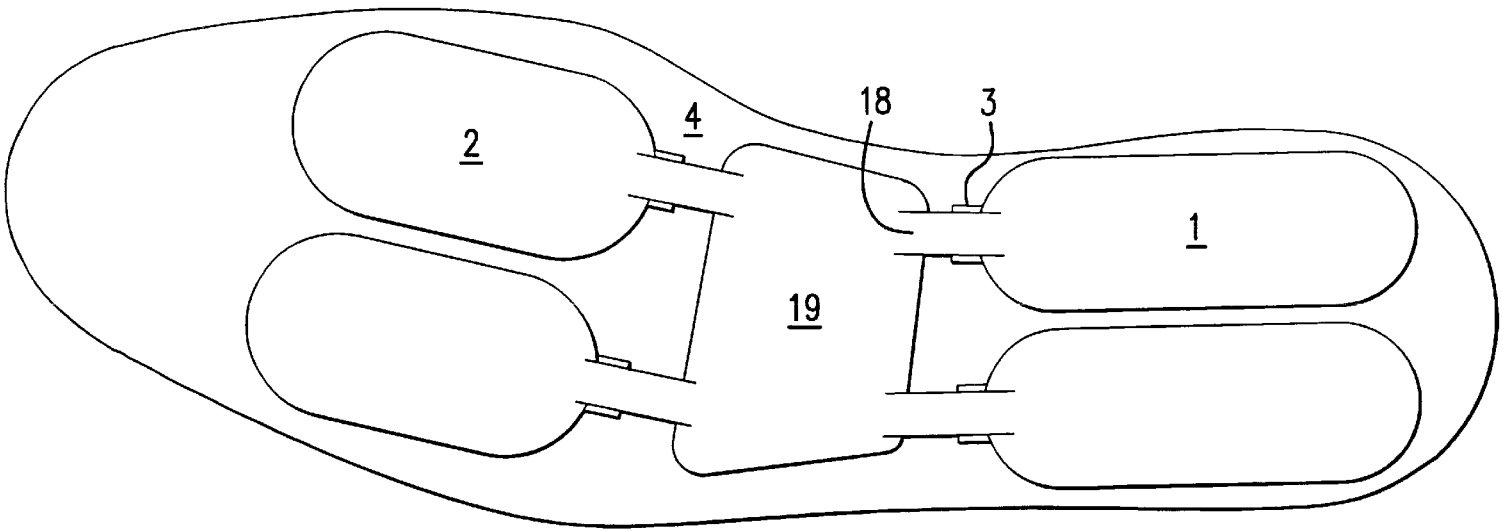
FIG. 8B is a plan view of the shoe midsole shown in FIG. 8A.

In the evening, when the shoes are not worn, the system must be re-inflated for the day after and therefore the user, taking on hands each shoe, will push the push-button (12) of all the valves (6). The systems, as described for applications A and B, can be adapted also for walking and running shoes. In this case only two bellows, as shown in FIG. 5, are studied because the front part of the sole does not allow the insertion of a bellows with at least two convolutions. Only for shoes with a roomy plant area may be possible the insertion of the plastic bellows in the front part of the sole. In FIG. 5 is shown a sole for a walking or a running shoe with two bellows (1) with the corresponding valves (6). In this case the user can adjust the foot position during the impact phase of a step. In FIG. 6 a sole for walking or running is shown, it is made with one bellows (1), without valve, in other words without any possibility for the adjustment. The object is to give the sole an extraordinary cushioning effect, due to the elasticity of the convolution of the bellows, which being produced with special technopolymers and vacuum formed, reacts as a spring each step. To speed up the production of the sole and the consequent construction of the shoe it will proceed as follows. Being these bellows produced with the process of blowing moulding or rotational moulding it is possible to insert inside the mould, and before the entering of the material, the whole sole or part of it with the consequence that once the material of the bellows is formed it is amalgamated with the material of the sole, avoiding the process of the gluing of the two materials. Another aspect to be considered is that the mould of the bellows can be produced forecasting the formation of some parts of the shoe upper as the heel contour or the braces which generally are made to support the laces.

For the application—D—the system will work as follows: Soles for the Support of the Plantar Arch This application derives from a Japanese concept which relates about the reflexology's principle based on the consideration that, supporting the plantar arch, a lot of pains can be avoided. For this reason it is possible to find in the market some special very short slippers characterized by a high support on the plantar arch, leaving the heel free and without any support. Obviously these special slippers can be worn only for a short time just for a period of few hours during the day. Using the bellows system as shown in FIG. 7 it is possible to adjust a slipper for this purpose acting as follows. In the position—N—the two bellows are completely inflated and the slipper is working as a normal one, supporting the whole foot plant and giving the foot a good feeling of cushioning. In the position —H—the bellows (19) remains inflated and the bellows (20) is deflated, acting on the valve (6). In this case this slipper will work as the Japanese one. Obviously this special system can work also using only one bellows, located in the rear part (20).

What is claimed is:

1. A plastic bellows system inserted into the sole of a shoe, said shoe sole including a midsole (4) and an outer sole (5) attached to midsole (4), said plastic bellows system comprising:

a) a first pair of side by side plastic bellows each formed with two convolutions and arranged in the forward portion of the shoe sole in hollows formed in said midsole (4);

b) a second pair of side by side plastic bellows each formed with three convolutions and arranged in the heel portion of the shoe sole in hollows formed in said midsole (4);

said first and second pairs of plastic bellows being formed by blow molding or rotational molding of engineering thermoplastic elastomers having high elastic modulus so that said bellows have instantaneous recovery following compression;

c) an opening formed in the lower convolution of each of said bellows of said first and second pairs of plastic bellows communicating via a tube (3,7) to the exterior of said midsole (4); and d) a pneumatic valve (6) associated with each of said bellows of said first and second pairs of plastic bellows and arranged in the tube communicating between each said bellows and the exterior of said midsole (4), whereby the user can modify foot position by operating the pneumatic valve of each bellows of said first and second pairs of plastic bellows to inflate or deflate each bellows to thereby modify the volume of each bellows.

2. The plastic bellows system inserted into the sole of a shoe as defined in claim 1, wherein said opening in the lower convolution of each bellows of said first and second pairs of plastic bellows is disposed on a longitudinal side of each said bellows arranged adjacent an exterior edge of said midsole.

3. The plastic bellows system inserted into the sole of a shoe as defined in claim 1, wherein said opening in the lower convolution of each bellows of said first and second pairs of plastic bellows is disposed on a head side of each said bellows.

4. The plastic bellows system inserted into the sole of a shoe as defined in claim 1, wherein said pneumatic valve (6) associated with each of said bellows comprises a ring shaped seat (11) inserted into the tube (3,7) communicating with said bellows, a push button (12) having an inner head and movable in said tube to seat against a gasket (14) of said ring shaped seat (11), and a spring (15) acting against the inner head of said push button to bias said push button against said ring shaped seat (11), said spring being disposed in said tube (3,7) between inner teeth (10) formed in said tube (3,7) and the inner head of said push button, whereby the depression of said push button allows air to enter into or exit from said bellows.

5. The plastic bellows system inserted into the sole of a shoe as defined in claim 1, wherein said midsole (4) is formed of foamed plastic material and during the molding of said first and second pairs of plastic bellows is amalgamated therewith.

* * * * *